United States Patent [19]

Rosenthal

[11] Patent Number: 4,696,045

[45] Date of Patent: Sep. 22, 1987

[54] EAR MICROPHONE

[75] Inventor: James M. Rosenthal, Cooper City, Fla.

[73] Assignee: ACR Electronics, Hollywood, Fla.

[21] Appl. No.: 741,249

[22] Filed: Jun. 4, 1985

[51] Int. Cl.[4] ..... H04R 1/04; H04R 1/10; H04R 1/46; H04R 17/02

[52] U.S. Cl. ..... 381/114; 381/151; 381/158; 381/169; 381/173; 381/189

[58] Field of Search ..... 179/107 BC, 110 A, 121 C, 179/180, 107 E, 179; 381/114, 151, 158, 168, 169, 173, 188, 189, 68.3, 68.6, 205

[56] References Cited

U.S. PATENT DOCUMENTS

| | | | |
|---|---|---|---|
| 4,150,262 | 4/1979 | Ono | 179/107 BC |
| 4,308,426 | 12/1981 | Kikuchi | 381/155 |
| 4,323,999 | 4/1982 | Yoshizawa et al. | 179/107 E |
| 4,334,315 | 6/1982 | Ono et al. | 179/107 BC |
| 4,453,045 | 6/1984 | Bruna | 179/180 |
| 4,546,950 | 10/1985 | Cech | 179/146 R |
| 4,588,867 | 5/1986 | Koromi | 179/107 E |
| 4,596,903 | 6/1986 | Yoshizawa | 381/173 |

FOREIGN PATENT DOCUMENTS

| | | | |
|---|---|---|---|
| 59-33388 | 3/1984 | Japan | 179/107 FD |
| 2160388A | 12/1985 | United Kingdom | 179/110 A |

*Primary Examiner*—Gene Z. Rubinson
*Assistant Examiner*—Danita R. Byrd
*Attorney, Agent, or Firm*—Darby & Darby

[57] ABSTRACT

An ear microphone includes a bimorph piezoelectric transducer mounted on a PC board having an amplifier therein and surrounded by a helically wound spring. The piezoelectric transducer and spring are potted in a semi-soft potting compound which is formed in a shape adapted to be inserted into an external auditory ear canal to permit bone conduction to the microphone element. A cable is coupled to the amplifier through which a signal can be withdrawn for processing by electronic equipment.

8 Claims, 4 Drawing Figures

EAR MICROPHONE

BACKGROUND OF THE INVENTION

1. Field of the Invention

This invention pertains to microphones and more particularly to ear microphones of the vibration pickup type that receive sound through bone conduction.

2. Description of the Prior Art

The high noise level existing in many environments such as on factory floors, and in the cockpits of small aircraft or in motorcycles, for example, prevents use of conventional microphones for electronic communication by, for example, intercom or radio, since conventional microphones pick up the noise making speech difficult to understand. Further, a person working in such environment often does not have the free use of his hands. In the factory, the person may be working with his hands, and while flying an airplane or operating a motor vehicle he will obviously need his hands to control the plane or motor vehicle. Therefore, microphones which need not be hand held and which are not sensitive to environmental noise are desirable in these and similar environments.

Ear microphones of the vibration pickup type are known which are fitted into the external auditory canal of the ear of the user to pickup his voice which is conducted through his bones to the external auditory canal wall. Such an ear microphone has been described and disclosed in U.S. Pat. No. 4,150,262.

Such devices however, pick up a substantial amount of environmental acoustical energy. Further, contamination from moisture or other pollutants can damage the microphone. Additionally, such devices can become extremely uncomfortable in the user's ear after extended use.

It is thus an object of the present invention to provide a microphone of the type designed to be inserted into the ear canal of the user to provide an electrical signal derived from the user's voice or other vibrations.

It is still another object of the invention to provide an ear microphone which effectively dampens environmental acoustic energy to cancel environmental noise.

It is yet another object of the invention to provide an ear microphone which is comfortable for extended periods of use in the user's ear.

It is a further object of this invention to provide an ear microphone that is impervious to moisture and environmental contaminants.

SUMMARY OF THE INVENTION

In accordance with an illustrative embodiment demonstrating objects and features of the present invention, there is provided an ear microphone for insertion into the external auditory canal of the ear of a user to pick up the user's voice, or other vibrations, via bone conduction within the user's body. The ear microphone includes an electroacoustic transducer that provides an electrical signal in response to mechanical vibration. The transducer is surrounded by a semi-soft compound which encases the transducer and dampens airborne noise that would otherwise be detected by the electroacoustic transducer. The semisoft compound additionally waterproofs the microphone and provides a comfortable casing that conforms to the user's external auditory canal. The foregoing brief description, as well as further objects, features and advantages of the present invention will be more completely understood from the following detailed description of a presently preferred, but nonetheless illustrative embodiment of the invention, with reference being had to the drawings herein.

DESCRIPTION OF THE PREFERRED EMBODIMENTS

Figure 1:
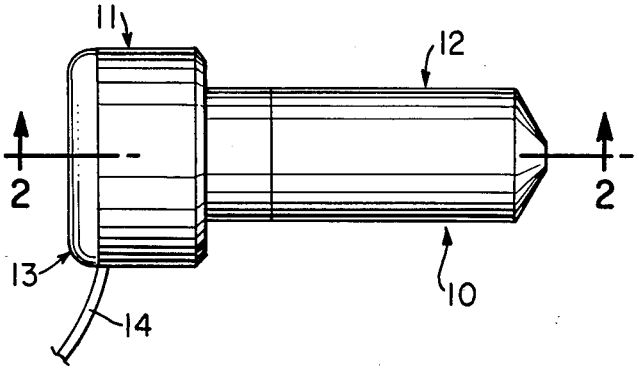
FIG. 1 is a side elevational view of the ear microphone in accordance with the present invention.

Referring now to FIGS. 1, 2, 3 and 4, FIG. 1 shows an external view of the microphone 10 according to the present invention in which housing 11 and element 12 enclose an electroacoustic transducer element 15. Cable 14 extends into housing 11 for connection to amplifier circuitry 16 also disposed within housing 11. Amplifier 16, which may be a semiconductor device or mounted on a printed circuit board 17, is in turn connected to transducer 15. The electrical signal from microphone 10 is carried by cable 14 for further processing, such as amplification and reproduction. Cover 13 is disposed on a rear end of housing 11 to form a closure for housing 11. Housing 11 and cover 13 may be of a rigid material, such as a hard plastic.

Figure 2:
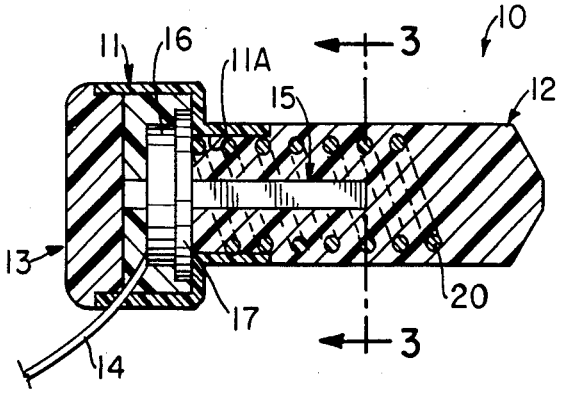
FIG. 2 is a cross-sectional view taken through line 2—2 of FIG. 1.

FIG. 2 is a cross-sectional view taken through line 2—2 of FIG. 1 and shows internal elements of the ear microphone 10. These elements include the microphone transducer element 15 which may be a piezoelectric bimorph, bender-mode type element. As will be clear to those skilled in the art, electroacoustic transducer elements other than piezoelectric elements can be used. Also, piezoelectric elements other than bender mode or bimorph elements can be used. Generally, as is known in the art, bimorph elements, which consist of two or more layers of crystal elements having an electrode therebetween, are up to 15 times more sensitive than "unimorph" elements. While twister-mode piezoelectric elements can also be used, bender mode piezoelectric elements, as described further, will be more sensitive to the mechanical vibrations found in the external auditory ear canal.

Amplifier 16 may be of any conventional type which amplifies the minute electric signals generated by the piezoelectric element. Amplifier 16 also provides a matched load to the output of transducer element 15. The amplified signal is coupled to cable 14.

Spring 20 is a helically coiled compression spring which acts as a protective device to surround piezoelectric transducer 15 and isolates it from severe mechanical shocks to prevent damage to transducer 15. Spring 20 can be inserted into opening 11A of housing 11 and held there by spring tension against an internal wall of housing 11. Transducer 15 and spring 20 both extend out from housing 11 through opening 11A.

Element 12 is of a semi-soft potting compound having sufficient flexibility to conform to the user's ear canal yet has sufficient rigidity to transmit vibrations received from the ear canal to the transducer. Element 12 has a generally cylindrical shape adapted to fit into the user's external auditory ear canal and contacting the walls thereof. Element 12 extends into opening 11A and encloses transducer 15 both in housing 11 and at its extension out of housing 11.

One potting compound that has been found useful is Silastic E RTV (room temperature vulcanizing) Silicone Rubber, manufactured by the Dow Corning Corporation. This material is a two-part room temperature curing molding rubber. It has a duro-meter hardness, Shore A, of 40 after a 7-day curing period. Element 12 has a generally cylindrical shape of a size adapted to fit snugly, yet comfortably within the user's external ear canal. Optimum operation of the microphone will result when element 12 is in intimate contact within the user's ear canal.

Figure 3:
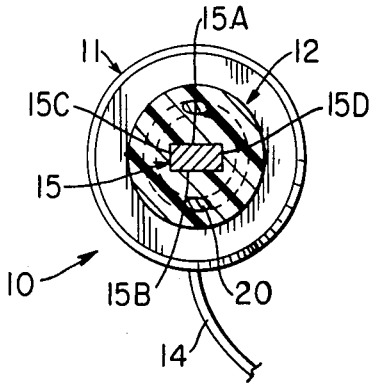
FIG. 3 is a cross-sectional view taken through line 3—3 of FIG. 1
Figure 4:
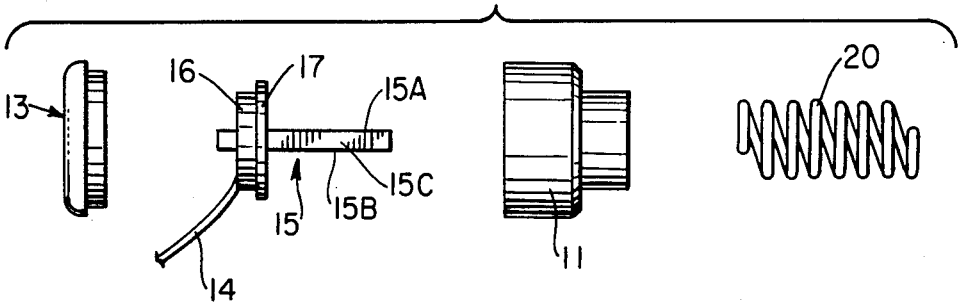
FIG. 4 is an exploded view showing assembly of elements of the present invention.

As shown in FIG. 3, the bender-mode, bimorph piezoelectric transducer 15 has a rectangular cross-section. Sides 15A and 15B are long sides of the rectangular cross-section, whereas 15C and 15D are short sides of the rectangular cross-section. The transducer is most sensitive to vibrations orthogonal to faces 15A and 15B, which vibrations are transmitted from the bone structure of the ear canal through element 12. Vibrations occuring in directions other than orthogonal to surfaces 15A and 15B and received by element 12 will generally include vector components which are orthogonal to sides 15A and 15B and therefore are sufficiently detectable by transducer 15. Also, a translation of the direction of energy will occur within element 12 so that vibrations which initially do not have vector components orthogonal to longitudinal faces 15A and 15B, will be translated so that they do have such orthogonal components.

Additionally, it will be noted that the piezoelectric transducer 15 will be at least partially sensitive to forces that are orthogonal to surfaces 15C and 15D although at a much reduced sensitivity.

In operation, the user's voice will be conducted from his throat through the bones of his head and to the walls of his external auditory ear canal. Element 12, in addition to providing conduction of vibrations from the wearer's ear canal to the piezoelectric transducer 15 also serves to dampen airborne vibrations. Internal losses within the semi-soft compound of element 12 will cause such dampening. Additionally, while the semi-soft compound of element 12 provides a reasonable mechanical impedance match to the human ear it does not provide nearly as good an acoustic impedance match to air and consequently, airborne acoustic energy does not couple well to the semi-soft compound nor therefore to piezoelectric element 15 contained therein. Furthermore, housing 11 and cover 13 will further block airborne acoustic energy from transducer 15. Thus, effective noise cancellation of ambient environmental noise is provided.

Further, the use of a soft rubber potting compound as described above permits complete waterproofing of the device, and insulates the piezoelectric element 15 and amplifier 16 from moisture which may be present in the wearer's ear or from other contaminants present in the environment in which the ear microphone is used.

What is claimed is:

1. An ear microphone comprising:

an electroacoustic transducer;

a rigid housing, said transducer being partially disposed within said housing and partially extending out from said housing;

a helically wound compression spring partially disposed within and supported by said housing, and partially extending outward of said housing and surrounding said transducer;

semi-soft compound enclosing at least a portion of said transducer and said spring, said semi-soft compound having a shape adapted for insertion into a user's ear, said compound being adapted to provide a better mechanical impedance match of said transducers to the human ear than to air to thereby reduce the effect of response of said transducer to airborne vibrations.

2. The ear microphone according to claim 1 wherein said semi-soft compound has a cylindrical shape adapted for insertion into a user's external auditory ear canal.

3. The ear microphone according to claim 2 wherein said electroacoustic transducer comprises a piezoelectric transducer.

4. The ear microphone according to claim 3 wherein said piezoelectric transducer comprises a bimorph piezoelectric transducer.

5. The ear microphone according to claim 4 wherein said bimorph piezoelectric transducer comprises a bender-mode piezoelectric transducer.

6. The ear microphone according to claim 5 wherein said transducer is of a rectangular parallelepiped shape having a longitudinal axis aligned with a longitudinal axis of said cylindrical shape of said compound and further includes long faces and short faces, said transducer being sensitive to forces on at least said long faces.

7. The ear microphone according to claim 1 wherein said semi-soft compound comprises a silicone rubber potting compound.

8. the apparatus acording to claim 1 further comprising an amplifier disposed within said housing.

* * * * *